US011677130B2

(12) United States Patent
Kim et al.

(10) Patent No.: US 11,677,130 B2
(45) **Date of Patent: *Jun. 13, 2023**

(54) WAVEGUIDE AND COMMUNICATION SYSTEM

(71) Applicant: 3M INNOVATIVE PROPERTIES COMPANY, St. Paul, MN (US)

(72) Inventors: Jaewon Kim, Woodbury, MN (US); Dipankar Ghosh, Oakdale, MN (US); Craig W. Lindsay, Minneapolis, MN (US); Matthew S. Stay, Minneapolis, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/508,341

(22) Filed: Oct. 22, 2021

(65) Prior Publication Data

US 2022/0045415 A1 Feb. 10, 2022

Related U.S. Application Data

(63) Continuation of application No. 16/756,189, filed as application No. PCT/IB2018/058204 on Oct. 22, 2018, now Pat. No. 11,189,898.

(Continued)

(51) Int. Cl.
*H01P 3/16* (2006.01)

(52) U.S. Cl.
CPC ..... *H01P 3/16* (2013.01)

(58) Field of Classification Search
CPC .... H01P 1/2088; H01P 1/2086; H01P 1/2084; H01P 1/208; H01P 3/16; H01P 3/12; H01P 3/122; H01P 3/121

(Continued)

(56) References Cited

U.S. PATENT DOCUMENTS 6,828,266 B1 12/2004 Park
7,230,817 B2 6/2007 Megherhi (Continued)

FOREIGN PATENT DOCUMENTS

CN 101673869 3/2010
JP 2017-152959 8/2017

(Continued)

OTHER PUBLICATIONS

Bouwstra, "Smart Jacket Design for Neonatal Monitoring with Wearable Sensors", IEEE—Proceedings of the 2009 Sixth International Workshop on Wearable and Implantable Body Sensor Networks, Jun. 2009, pp. 162-167.

(Continued)

*Primary Examiner* — Stephen E. Jones
(74) *Attorney, Agent, or Firm* — Clifton F. Richardson

(57) ABSTRACT

A waveguide for receiving an incident electromagnetic wave (EMW) having an operating frequency Γ includes an array of spaced apart unit cells arranged along the waveguide. The unit cells are configured to resonantly couple to the incident EMW and radiate an EMW at the operating frequency propagating inside and along the waveguide. Each unit cell is configured to couple to the incident EMW with a first coupling efficiency and includes a dielectric body configured to couple to the incident EMW with a second coupling efficiency and one or more metal layers disposed on and partially covering the dielectric body. The second coupling efficiency is substantially smaller than the first coupling efficiency. A communication system includes the waveguide and a transceiver configured to emit an EMW having the operating frequency Γ.

15 Claims, 14 Drawing Sheets

Related U.S. Application Data

(60) Provisional application No. 62/577,462, filed on Oct. 26, 2017.

(58) Field of Classification Search
USPC ..... 333/239, 248
See application file for complete search history.

(56) References Cited

U.S. PATENT DOCUMENTS

| | | | | |
|---|---|---|---|---|
| 11,189,898 | B2 * | 11/2021 | Kim | H01P 3/122 |
| 2005/0083241 | A1 | 4/2005 | Zarro | |
| 2015/0048907 | A1 | 2/2015 | Almgren | |
| 2016/0363726 | A1 | 12/2016 | Alisafaee et al. | |

FOREIGN PATENT DOCUMENTS

| | | |
|---|---|---|
| KR | 2011-0101914 | 9/2011 |
| WO | 2016-171930 | 10/2016 |
| WO | 2016-172020 | 10/2016 |

OTHER PUBLICATIONS

Chandran, "Pattern Switching Compact Patch Antenna for On-body and Off-body Communications at 2.45GHz", IEEE—2009 3rd European Conference on Antennas and Propagation, Mar. 2009, pp. 2055-2057.

Han, "New Preparation Method of Low-Temperature-Sinterable Perovskite 0.9Pb(Mg 1/3 Nb 2/3)O 3-0.IPbTiO 3 Powder and Its Dielectric Properties", Journal of the American Ceramic Society, Nov. 1998, vol. 81, No. 11, pp. 2998-3000.

Michishita, "Recent Progress of Dielectric Resonator-Based Left-Handed Metamaterials", 2007 International Symposium on Signals, Systems and Electronics, IEEE Xplore. Aug. 27, 2007, pp. 143-146.

Sato, "Design of Isotropic 3-D Multilayered CRLH Metamaterial Structures Using Conductive Mesh Plates and Dielectric Resonators", IEEE—Proceedings of the Asia-Pacific Microwave Conference 2011, Dec. 2011, pp. 526-529.

International Search Report for PCT International Application No. PCT/IB2018/058204, dated Jan. 31, 2019, 5 pages.

* cited by examiner

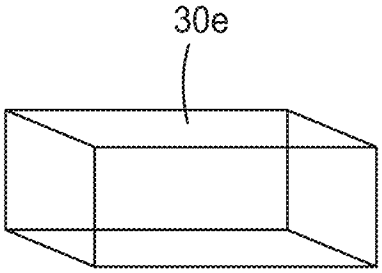
FIG. 10D
FIG. 10E
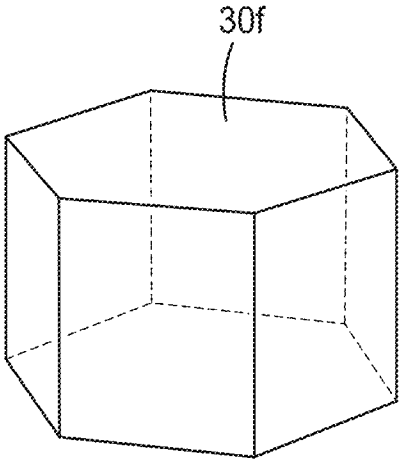
FIG. 10F

WAVEGUIDE AND COMMUNICATION SYSTEM

BACKGROUND

A waveguide can be used to guide electromagnetic waves along a length of the waveguide.

SUMMARY

In some aspects of the present description, a waveguide configured to propagate an electromagnetic wave (EMW) having an operating frequency Γ along the waveguide is provided. The waveguide includes a dielectric substrate having a first dielectric constant, and an array of spaced apart unit cells at least partially embedded in the substrate and arranged along the waveguide. Each of a plurality of the unit cells in the array of spaced apart unit cells has a first transmission parameter $S_1 21$ having a lowest resonant frequency Γ1 and includes a dielectric body having a second dielectric constant greater than the first dielectric constant at the operating frequency and having a second transmission parameter $S_2 21$ having a lowest resonant frequency Γ2, and further includes one or more electrically conductive layers disposed on and partially covering the dielectric body. Γ2 is greater than Γ1.

In some aspects of the present description, a waveguide including a dielectric substrate and an array of spaced apart unit cells at least partially embedded in the substrate and arranged along the waveguide is provided. Each unit cell has a first transmission parameter $S_1 21$ having a first resonant frequency Γ3 having a first electric field intensity distribution. Each unit cell includes a dielectric body having a second transmission parameter $S_2 21$ having a lowest resonant frequency Γ2 having a second electric field intensity distribution, and includes a metal layer disposed on and partially covering the dielectric body. The first and second electric field intensity distributions have a same mode profile. The first resonant frequency Γ3 is not a lowest resonant frequency Γ1 of $S_1 21$.

In some aspects of the present description, a communication system including a first transceiver configured to emit an electromagnetic wave (EMW) having an operating frequency Γ, and including a waveguide for receiving the emitted EMW having the operating frequency Γ from the first transceiver is provided. The waveguide includes a substrate extending between first and second locations of the waveguide, and an array of spaced apart unit cells at least partially embedded in the substrate and extending between the first and second locations of the waveguide. The unit cells are configured to resonantly couple to the emitted EMW having the operating frequency Γ at the first location and radiate an EMW at the operating frequency propagating inside and along the waveguide from the first location to the second location along the waveguide. Each unit cell has a first transmission parameter $S_1 21$ and a first reflection parameter $S_1 11$. $S_1 21$ and $S_1 11$ are within 10% of each other at the operating frequency Γ.

In some aspects of the present description, a waveguide for receiving an incident electromagnetic wave (EMW) having an operating frequency Γ and comprising an array of spaced apart unit cells arranged along the waveguide is provided. The unit cells are configured to resonantly couple to the incident EMW and radiate an EMW at the operating frequency propagating inside and along the waveguide. Each unit cell is configured to couple to the incident EMW with a first coupling efficiency. Each unit cell includes a dielectric body configured to couple to the incident EMW with a second coupling efficiency, and includes one or more metal layers disposed on and partially covering the dielectric body. The second coupling efficiency is substantially smaller than the first coupling efficiency.

BRIEF DESCRIPTION OF THE DRAWINGS

FIGS. 10A-10J are schematic perspective views of dielectric bodies.

DETAILED DESCRIPTION

Figure 1A:
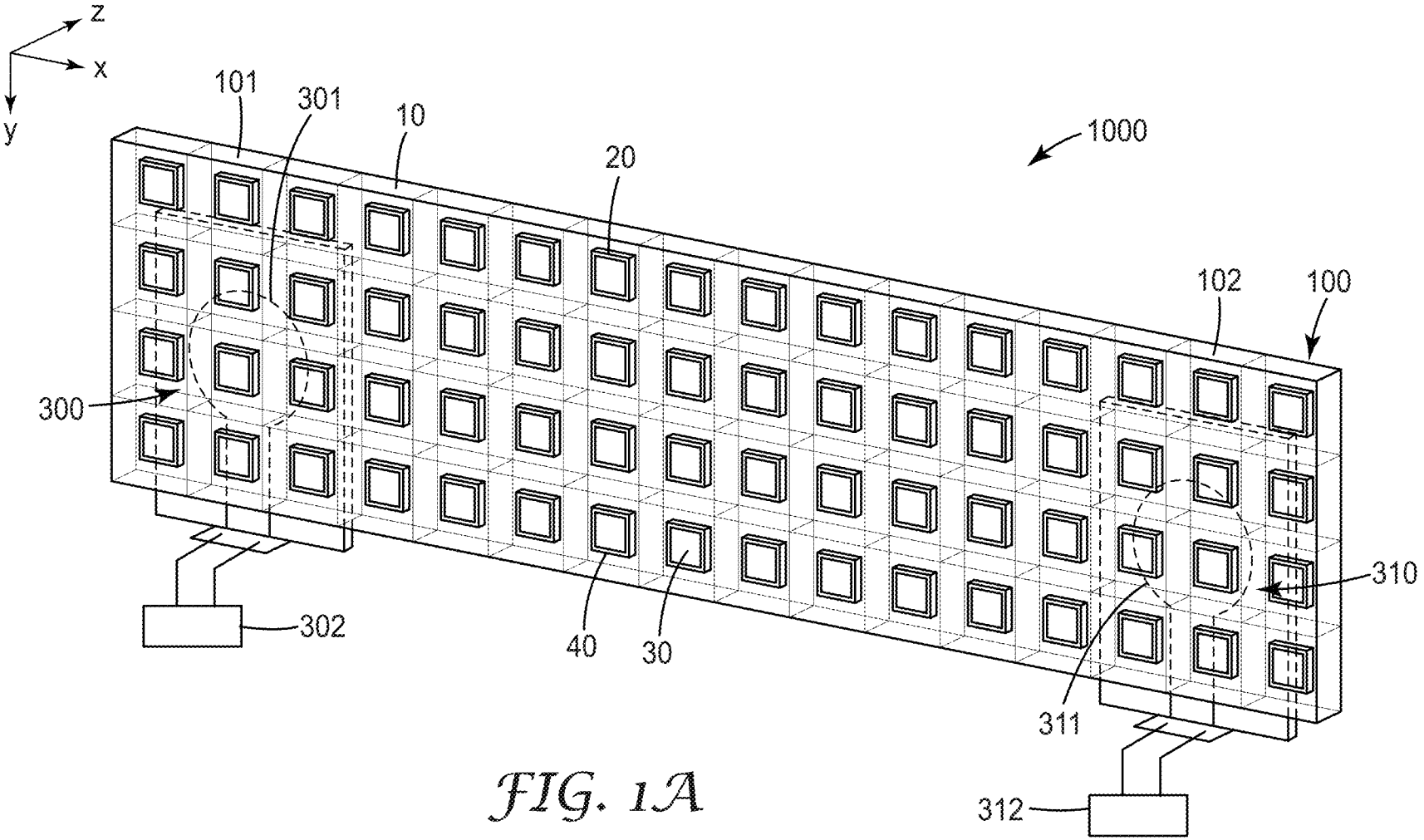
FIG. 1A is a front perspective view of a communication system including a waveguide and first and second transceivers.

In the following description, reference is made to the accompanying drawings that form a part hereof and in which various embodiments are shown by way of illustration. The drawings are not necessarily to scale. It is to be understood that other embodiments are contemplated and may be made without departing from the scope or spirit of the present description. The following detailed description, therefore, is not to be taken in a limiting sense.

Some aspects of the present description relate to a waveguide configured to propagate an electromagnetic wave (EMW). In some embodiments, the waveguide includes a plurality of unit cells where each the unit cell includes a dielectric body and one or more electrically conductive layers (e.g., metal layer(s)) disposed on the dielectric body. In some embodiments, the dielectric bodies are spaced in such a way as to allow energy transfer between the dielectric bodies. The conductive layer(s) may increase a coupling efficiency of an incident EMW to the unit cell compared to a coupling efficiency of the incident EMW to the dielectric body without the conductive layer(s). In some embodiments, the dielectric body with the one or more electrically conductive layers are high dielectric resonators (HDRs). HDRs are objects that are crafted to resonate at a particular frequency. When an EMW having a frequency at or near to that of the resonant frequency of an HDR is received by the waveguide, the HDRs resonantly couple to the received EMW and radiate an EMW that propagates inside and along the waveguide. The resonant frequency depends on the size and the dielectric constant of the dielectric body. In some cases, reducing the size of the dielectric body increases the resonant frequency beyond a desired range even when a high dielectric constant (e.g., at least 50) material is used. According to some aspects of the present description, it has been found that utilizing one or more electrically conductive layers on a dielectric body allows a smaller (e.g., thinner) dielectric body to be utilized while achieving a desired resonant frequency and that this can result in a thinner waveguide that can efficiently guide an electromagnetic (EM) wave.

The waveguides of the present description can be used in a variety of systems. For, example, the waveguides can be used in one or more of 60 GHz communication, communication at another predetermined frequency, underground communication, body area networks, and body sensor networks. In some embodiments, the waveguide is electromagnetically coupled to a first transceiver and a second transceiver, such that signals can be transmitted from the first transceiver to the second transceiver through the waveguide or vice versa and then transmitted wirelessly from the first and/or second transceiver. In some cases, the waveguide can be disposed on or integrated with a garment such that the garment can facilitate and/or propagate signal collection on a human body. In some case, the first and/or the second transceivers are electrically coupled to one or more sensors and configured to transmit or receive the sensor signals.

Figure 1B:
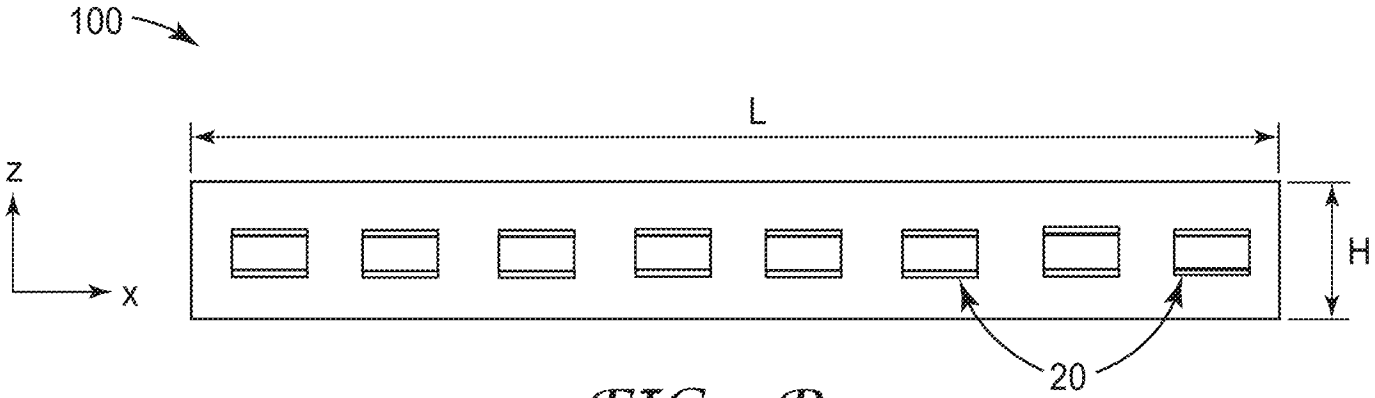
FIGS. 1B-1C are schematic cross-sectional views of the waveguide of FIG. 1A.
Figure 1C:
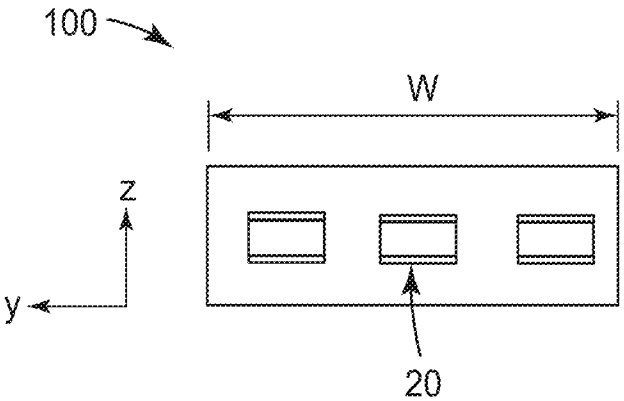
Figure 1D:
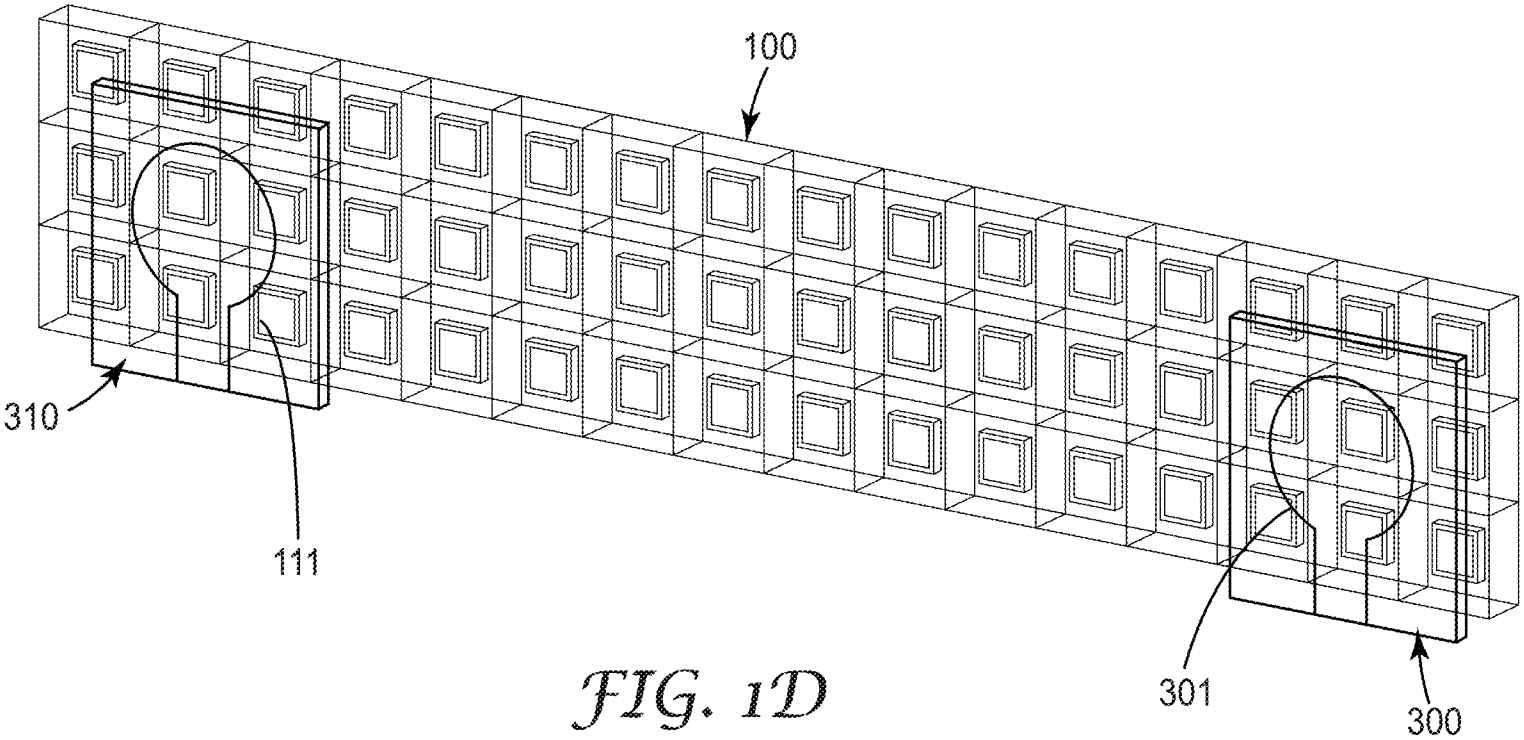
FIG. 1D is a rear perspective view of the waveguide and first and second transceivers of FIG. 1A.

FIG. 1A is a front perspective view of a communication system 1000 including a waveguide 100 and first and second transceivers 300 and 310. The waveguide 100 is configured to propagate an electromagnetic wave having an operating frequency Γ along the waveguide. The waveguide 100 includes a dielectric substrate having a first dielectric constant, and an array of spaced apart unit cells 20 at least partially embedded in the substrate 10 and arranged along the waveguide 100. Each of a plurality of the unit cells in the array of spaced apart unit cells 20 includes a dielectric body 30 having a second dielectric constant greater than the first dielectric constant at the operating frequency, and one or more electrically conductive layers 40 disposed on and partially covering the dielectric body 30. An x-y-z coordinate system is illustrated in FIG. 1A. FIGS. 1B and 1C are schematic cross-sectional views of the waveguide 100 in x-y and y-z planes, respectively. FIG. 1D is a rear perspective view of the waveguide 100 and the first and second transceivers 300 and 310. The waveguide 100 has a length L, a width W and a thickness H. In some embodiments, the length L is substantially larger than the width W, and the width W is substantially larger than the thickness H. In some embodiments, L≥W≥H, or L≥W≥2H, or L≥5W≥10H.

In some embodiments, the substrate 10 extends between first 101 and second 102 locations of the waveguide 100 and the array of spaced apart unit cells 20 extend between the first and second locations 101 and 102 of the waveguide. The first transceiver 300 is configured to emit an electromagnetic wave (EMW) having the operating frequency operating frequency Γ. In some embodiments, the unit cells 20 are configured to resonantly couple to the emitted EMW having the operating frequency Γ at the first location and radiate an EMW at the operating frequency propagating inside and along the waveguide from the first location 101 to the second location 102 along the waveguide 100. The first transceiver 300 includes a first antenna 301 and a first power source 302 to energize the first antenna 301. The second transceiver 310 includes a second antenna 311 and a second power source 312 to power the second antenna 311. The second transceiver 310 is configured to resonantly couple to the EMW propagating inside and along the waveguide at the second location 102 of the waveguide 100. In some embodiments, the second transceiver 310 is further configured to radiate the coupled EMW to a location remote from the waveguide 100. For example, the second transceiver 310 may be configured to wirelessly communicate with a control unit remote from the waveguide 100.

Figure 2A:
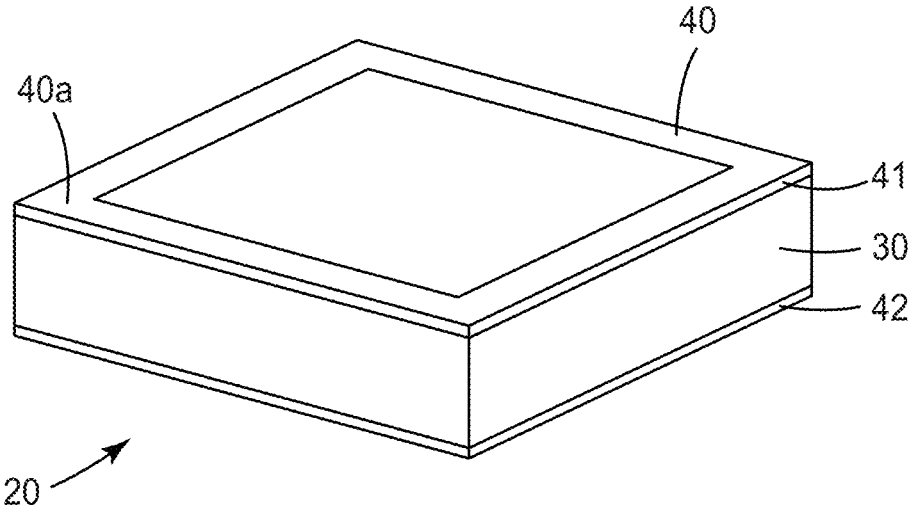
FIG. 2A is a schematic perspective view of a unit cell.
Figure 2B:
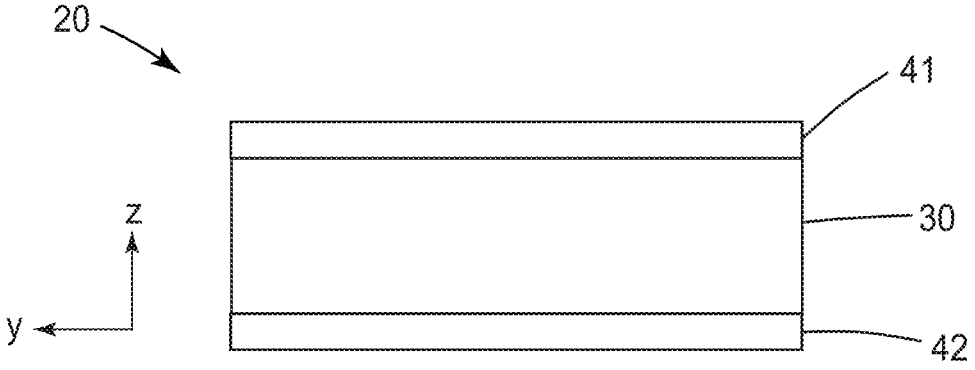
FIG. 2B is a schematic side view of the unit cell of FIG. 2A.

FIG. 2A is a schematic perspective view of the unit cell 20. One or more conductive layers 40 are disposed on and partially covers the dielectric body 30. In the illustrated embodiment, the one or more electrically conductive layers 40 includes first and second layers 41 and 42. In the illustrated embodiment, the conductive layer 41 comprises a closed loop electrically conductive strip 40*a*. In some embodiments, one or more electrically conductive layers are disposed on a dielectric body where at least one layer in the one or more electrically conductive layers defines an opening therein (e.g., the interior of the closed loop electrically conductive strip 40*a*) to allow at least a partial transmission of an incident electromagnetic wave (EMW) therethrough. FIG. 2B is a schematic side view of the unit cell 20. In some embodiments, one or more electrically conductive layers are disposed on a dielectric body where the one or more electrically conductive layers include substantially identical electrically conductive first and second layers disposed on opposite sides of the dielectric body and registered and aligned with each other.

In some embodiments, at least one layer in the one or more electrically conductive layers 40 is a metal layer. Suitable metals include silver, gold, copper, aluminum, platinum, and alloys thereof. In some embodiments, at least one layer in the one or more electrically conductive layers 40 is an electrically conductive ceramic. Suitable electrically conductive ceramics include doped and undoped $LaCrO_3$, Indium Tin Oxide (ITO), TiO, $TiC_xN_{1-x}$, $RuO_2$, ZrC, TiC, TiN, TaN, and $ZrB_{2x}$—$B_4C_{1-x}$, and $ZrB_{2x}$—$SiC_{1-x}$. In some embodiments, each layer in the one or more electrically conductive layers 40 is a metal layer, or each layer is an electrically conductive ceramic, or at least one layer is a metal layer and at least one other layer is an electrically conductive ceramic. The thicknesses of the one or more electrically conductive layers 40 can be chosen to be greater than the skin depth of the conducive layer at the operating frequency. In some embodiments, an average thickness of at least one layer in the one or more electrically conductive layers 40 is in a range from about 100 nm to about 100 micrometers, or in a range from about 100 nm to about 10 micrometers, or in a range from about 100 nm to about 5 micrometers.

In some embodiments, the size of the dielectric body 30 is selected to achieve a desired resonant frequency which is, in some embodiments, close to an operating frequency of the waveguide 100 as described further elsewhere herein. The spacing between unit cells 20 can be chosen to so that a resonance energy of one unit cell can efficiently transfer to adjacent unit cells. In some embodiments, a center-to-center spacing or pitch of the unit cells 20 is selected to be substantially smaller than the wavelength of an EM wave propagating in air at the operating frequency. For example, the pitch may be less than 0.5 times, or less than 0.3 times, or less than 0.2 times the wavelength. In some embodiments, the pitch is sufficiently large that the space between adjacent unit cells 20 is at least a thickness of the unit cells 20. In some embodiments, the ratio of the width of the unit cell 20 to the pitch is in a range of about 0.5 to about 0.9 (e.g., about 0.7). In some embodiments, the thickness of the dielectric body is in a range of about 0.1 mm to about 10 mm, or in a range of about 0.2 mm to about 5 mm, or in a range of about 0.4 mm to about 2.5 mm.

In some embodiments, the substrate 10 comprises one or more of a polytetrafluoroethylene, a quartz glass, a cordierite, a borosilicate glass, a perfluoroalkoxy, a polyurethane, a polyethylene, silicone, a polyolefin, and a fluorinated ethylene propylene. A suitable polytetrafluoroethylene is Teflon®. In some embodiments, the substrate 10 is air or primarily air. For example, waveguide 100 can be formed by placing the unit cells 20 on an outer surface of the layer. In this case, the substrate in which the unit cells 20 are embedded is the air adjacent the layer. In some embodiments, the substrate 10 is porous (e.g., a porous polymer). In some embodiments, the volume of air in the porous substrate is greater than the volume of non-air (e.g., polymer) material so that the substrate 10 can be described as primarily air.

In some embodiments, the waveguide 100 is flexible. For example, in some embodiments, the waveguide 100 can be bent to a radius of curvature of 10 cm or less without permanent deformation, breaking or cracking. The waveguide 100 can be flexible when the substrate 10 is made from a flexible polymer, for example. In some embodiment, the waveguide 100 is rigid. For example, in some embodiments, the waveguide 100 cannot be bent to a radius of curvature of less than 100 cm without permanent deformation, breaking or cracking. The waveguide 100 can be rigid when the substrate 10 is made from a rigid glass or ceramic, for example.

The first and second dielectric constants of the substrate and dielectric body, respectively, may be specified at a specific frequency (e.g., 10 GHz) or at the operating frequency of the waveguide. The first and second dielectric constants are the respective values at the operating frequency except where another frequency is specified. In some embodiments, the first dielectric constant is in a range from about 1 to about 10 at a frequency of about 10 GHz or at the operating frequency. In some embodiments, the first dielectric constant is in a range of 1.1 to about 5 at the operating frequency or at a frequency of about 10 GHz.

In some embodiments, the dielectric bodies are made of a ceramic material. Suitable example materials for the dielectric bodies include BaZnTa oxide, BaZnCoNb oxide, Zirconium-based ceramics, Titanium-based ceramics, Barium Titanate-based materials, Titanium oxide-based materials, Y5V compositions (e.g., those described in U.S. Pat. No. 7,230,817 (Megherhi et al.)), X7R compositions (e.g., those described in U.S. Pat. No. 6,838,266 (Park et al.)), doped or undoped Barium Titanate ($BaTiO_3$), Barium Strontium Titanate ($BaSrTiO_3$), $TiO_2$ (Titanium dioxide), Calcium Copper Titanate ($CaCu_3Ti_4O_{12}$), Lead Zirconium Titanate ($PbZr_xTi_{1-x}O_3$), Lead Titanate ($PbTiO_3$), Lead Magnesium Titanate ($PbMgTiO_3$), Lead Magnesium Niobate-Lead Titanate ($Pb(Mg_{1/3}Nb_{2/3})O_3$.—$PbTiO_3$), Iron Titanium Tantalate ($FeTiTaO_6$), NiO co-doped with Li and Ti ($La_{1.5}Sr_{0.5}NiO_4$, $Nd_{1.5}Sr_{0.5}NiO_4$), and combinations thereof. An example of a high dielectric constant material is $0.9Pb(Mg_{1/3}Nb_{2/3})O_3$—$0.1PbTiO_3$ which has a dielectric constant of 24700 at a frequency of 1 kHz when calcined at 1100° C. as described in R. Kyoung, K. Sojin and J. H. Koo, *J. Am. Ceram. Soc.*, 81, 2998 (1998).

In some embodiments, the dielectric bodies may be treated to increase the dielectric constant. For example, at least one of the dielectric bodies may be heat treated. As another example, at least one of the dielectric bodies may be sintered. In such examples, the at least one dielectric body may be sintered at a temperature higher than 600° C. for a period of two to four hours. In other cases, the at least one dielectric body may be sintered at a temperature higher than 900° C. for a period of two to four hours.

In some embodiments, the second dielectric constant is in a range from about 10 to about 25000 at a frequency of about 10 GHz or at the operating frequency. In some embodiments, the second dielectric constant is at least 20, or at least 30, or at least 40, or at least 50 at the operating frequency or at a frequency of about 10 GHz. In some embodiments, the second dielectric constant is in a range of 20 to about 20000 at the operating frequency or at a frequency of about 10 GHz. In some embodiments, the second dielectric constant is at least 5 times, or at least 10 times the first dielectric constant. Utilizing a second dielectric constant that is substantially greater than the first dielectric constant allows the energy of the EMW to be more concentrated in the dielectric bodies and this has been found to improve the performance of the waveguide.

Figure 3:
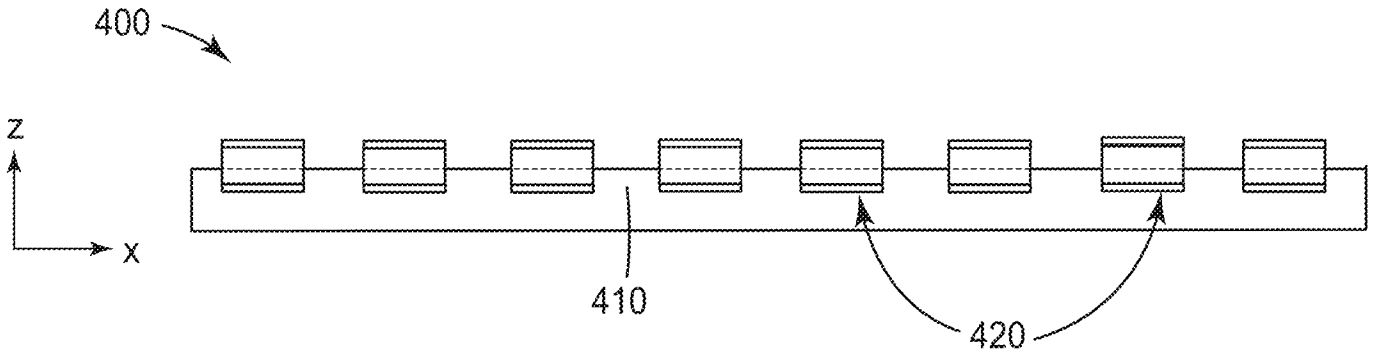
FIG. 3 is a schematic cross-sectional view of a waveguide.

FIG. 3 is a schematic cross-sectional view of a waveguide 400 including an array of spaced apart unit cells 420 partially embedded in a substrate 410. Waveguide 400 may correspond to waveguide 100 except that the unit cells 20 of waveguide 100 are fully embedded in substrate 10 while the unit cells 420 are only partially embedded in substrate 410. Alternatively, waveguide 400 may correspond to only one row of waveguide 100 so that the array of spaced apart unit cells 420 is a one-dimensional array. In some embodiments, some of the unit cells are partially embedded in the substrate and some are fully embedded in the substrate. For example, some of the unit cells 420 may be disposed lower in the z-direction than others so that some are fully embedded and others are partially embedded. In some embodiments, at least one unit cell in the array of the spaced apart unit cells is only partially embedded in the substrate. In some embodiments, each unit cell in the array of the spaced apart unit cells is only partially embedded in the substrate. In some embodiments, at least one unit cell in the array of the spaced apart unit cells is fully embedded in the substrate. In some embodiments, each unit cell in the array of the spaced apart unit cells is fully embedded in the substrate.

The dielectric body, the unit cell comprising the dielectric body, and the waveguide comprising the array of unit cells can each be characterized in terms of S-parameters. The S-parameter characterizing the transmission of an incident EM wave is conventionally denoted S21 and may be described as a transmission coefficient, and the S-parameter characterizing the reflection of an incident EM wave is conventionally denoted S11 and may be described as a reflection coefficient.

Figure 4:
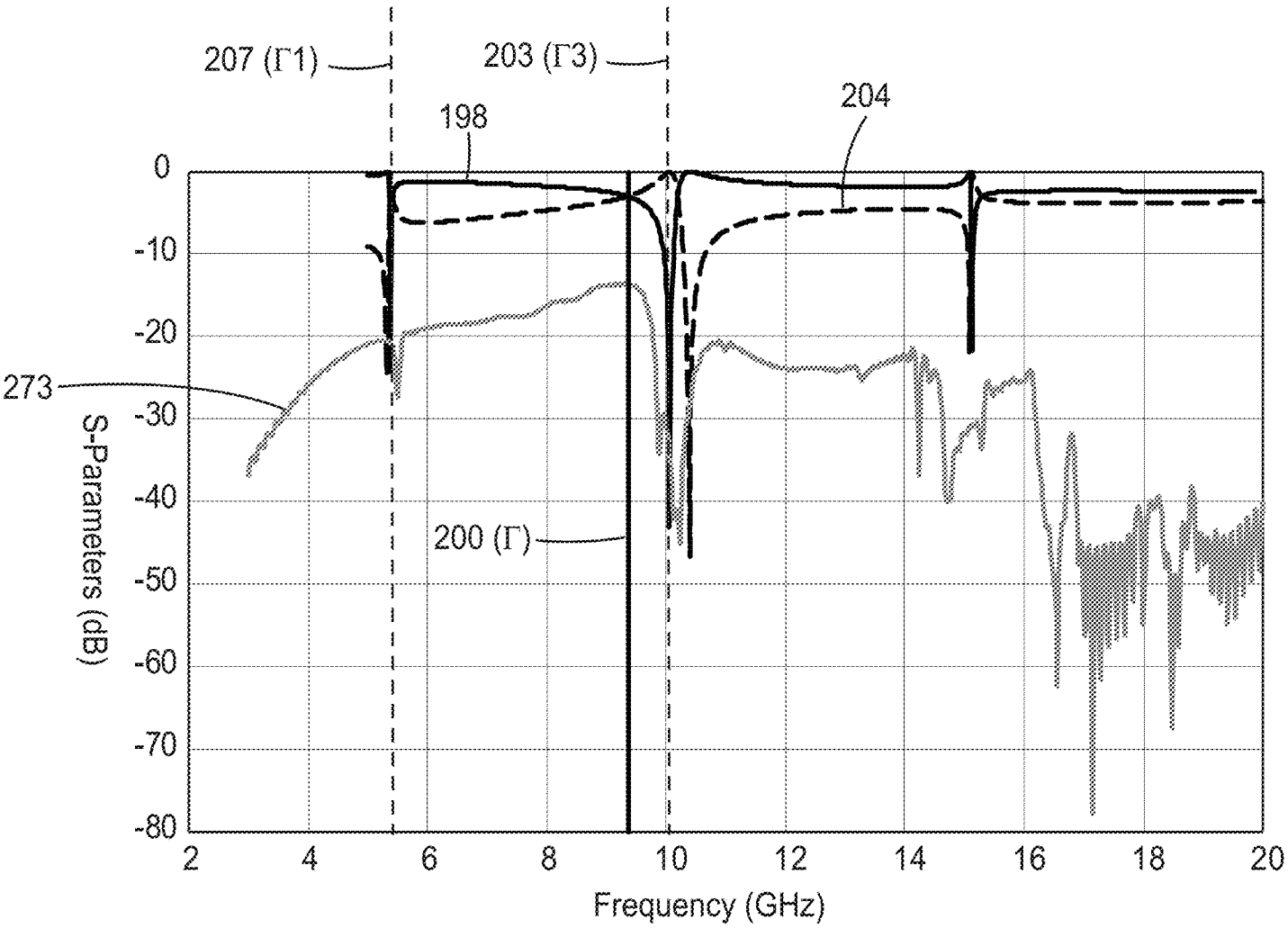
FIGS. 4-5 are plots of S-parameters versus frequency.

FIG. 4 is a plot of various calculated S-parameters (in dB) versus frequency for a waveguide and unit cells corresponding to the waveguide 100 and the unit cells 20. The substrate was modeled as Teflon® having a dielectric constant of 2.1 and a thickness of 4 mm. The dielectric body was modeled as having dimensions of 4 mm×4 mm×1 mm and a dielectric constant of 35. The center-to-center spacing between the dielectric bodies was 8 mm. The metallic layers were modeled as having a constant width of 0.4 mm around the borders at each of the 4 mm×4 mm faces of the dielectric bodies. The S21 parameter 273 for the waveguide is shown. The S21 parameter 273 is a maximum at the operating frequency Γ (200) of 9.3717 GHz. A first transmission parameter $S_121$ (198) of the unit cell and a first reflection parameter $S_111$ (204) of the unit cell are also shown. The first transmission parameter $S_121$ (198) has a lowest resonant frequency Γ1 (207) and a first resonant frequency Γ3 (203). In some embodiments, the first resonant frequency Γ3 (203) is not equal to lowest resonant frequency Γ1 (207) of $S_121$. In some embodiments, Γ3−Γ1 is greater than 1 GHz, or greater than 2 GHz, or greater than 3 GHz. In some embodiments, Γ1 is greater than 1 GHz, or greater than 2 GHz. In some embodiments, Γ1 is less than 10 GHz.

Figure 5:
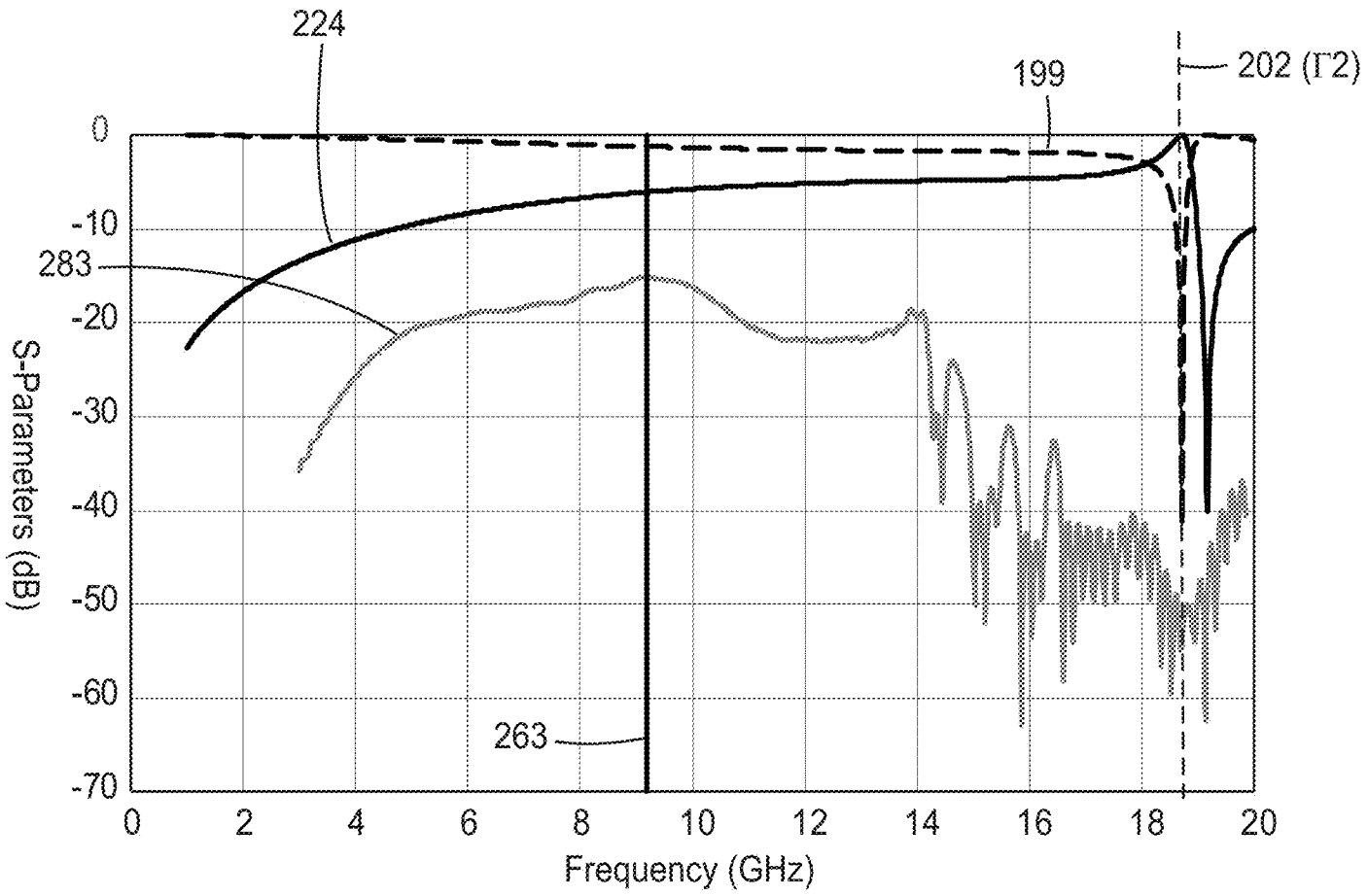

FIG. 5 is a plot of various S-parameters (in dB) versus frequency for a waveguide, and for the unit cells of the waveguide, otherwise equivalent to the waveguide modeled in FIG. 4 but without the electrically conductive layers disposed on the dielectric body. The S21 parameter 283 for the waveguide is shown. The S21 parameter 283 is a maximum at a frequency 263 of 9.1733 GHz. The dielectric body has a second transmission parameter $S_2$21 (199) having a lowest resonant frequency Γ2 (202). The dielectric body also has a second reflection parameter $S_2$11 (224).

In some embodiments, Γ2 is greater than 5 GHz, or greater than 10 GHz, or greater than 15 GHz. In some embodiments, Γ2 is less than 200 GHz, or less than 120 GHz. In some embodiments, Γ2>Γ1. In some embodiments, Γ2−Γ1 is at least 1 GHz, or at least 2 GHz, or at least 5 GHz, or at least 7 GHz, or at least 10 GHz.

In some embodiments, the operating frequency Γ is at least about 10 MHz, or at least about 100 MHz, or at least about 1 GHz; and is no more than about 120 GHz, or no more than about 50 GHz, or no more than about 40 GHz, or no more than about 30 GHz, or no more than about 20 GHz, or no more than about 15 GHz, or no more than about 1 GHz. For example, in some embodiments, the operating frequency Γ is in a range of from about 10 MHz to about 120 GHz, or in a range from about 10 MHz to about 50 GHz, or in a range from about 1 GHz to about 40 GHz, or in a range from about 1 GHz to about 30 GHz, or in a range from about 1 GHz to about 20 GHz, or in a range from about 1 GHz to about 15 GHz, or from about 10 MHz to about 1 GHz.

The operating frequency Γ is a frequency where the S21 parameter 273 for the waveguide is at or near a maximum. The operating frequency Γ is typically near a resonant frequency of the unit cells. In some embodiments, |Γ−Γ1| is less than 2 GHz, or less than 1 GHz. In some embodiments, |Γ−Γ1|/Γ is less than 0.2, or less than 0.15, or less than 0.1, or less than 0.08. Since the operating frequency Γ is typically near a resonant frequency, the transmission parameter $S_1$21 and the reflection parameter $S_1$11 are typically close to each other at the operating frequency Γ. In some embodiments, $S_1$21 and $S_1$11 are within 10% of each other, or within 5% of each other at the operating frequency Γ. In some embodiments, $S_1$11 is equal to $S_1$21 at the operating frequency Γ.

The value of the S21 parameter 273 at the operating frequency Γ is typically greater than the value of the S21 parameter 283 at the operating frequency Γ or at the frequency 263 where the S21 parameter 283 is a maximum. For example, for the embodiment of FIGS. 4-5, the S21 parameter 273 at the operating frequency Γ is −13.7235 dB and the S21 parameter 283 at the frequency 263 is −15.1465 dB. The implies that the power transmitted along the waveguide when the metal layers are included is about 1.39 times higher than the power transmitted when the metal layers are not included. This difference can be understood in terms of coupling efficiency. A component (e.g., unit cell or dielectric body) couples to an incident EM wave with a coupling efficiency which is the fraction or percentage of the incident energy that is transferred to the component (e.g., a portion of the energy of the incident EM wave can be transferred to a mode of the unit cell having a resonant frequency near the frequency of the incident EM wave). In some embodiments, each unit cell is configured to couple to the incident EM wave with a first coupling efficiency and the dielectric body of the unit cell is configured to couple to the incident EM wave with a second coupling efficiency. That the transmitted power is reduced by a factor of about 1.39 in the embodiment of FIGS. 4-5 when the metal layers are not included shows that the second coupling efficiency is substantially smaller than the first coupling efficiency in this embodiment. A second coupling efficiency may be described as substantially smaller than the first coupling efficiency if the second coupling efficiency is at least 20 percent smaller than the first coupling efficiency. In some embodiments, the second coupling efficiency is at least 2 times smaller than the first coupling efficiency (i.e., the second coupling efficiency is no more than the first coupling efficiency divided by 2). In some embodiments, the second coupling efficiency is at least 5 times, or at least 10 times, or at least 20 times smaller than the first coupling efficiency.

Figure 6A:
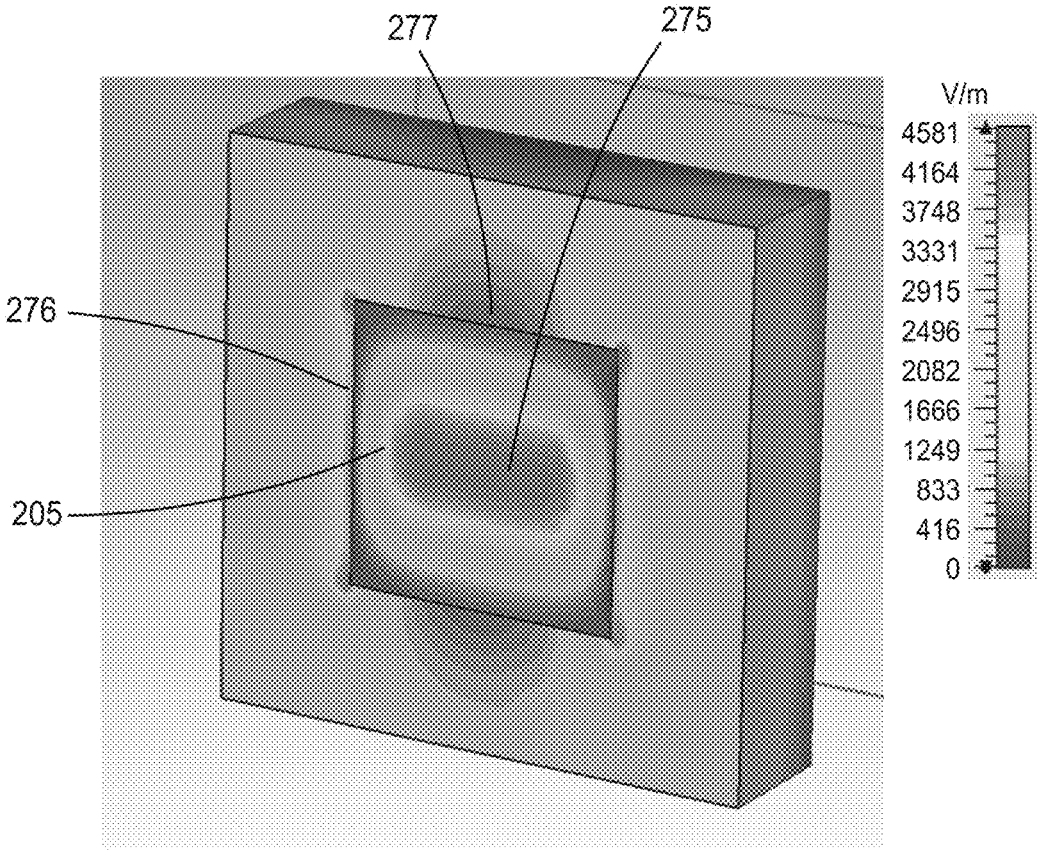
FIGS. 6A-6C are plots of the electric field intensity distributions in and around a unit cell.
Figure 6B:
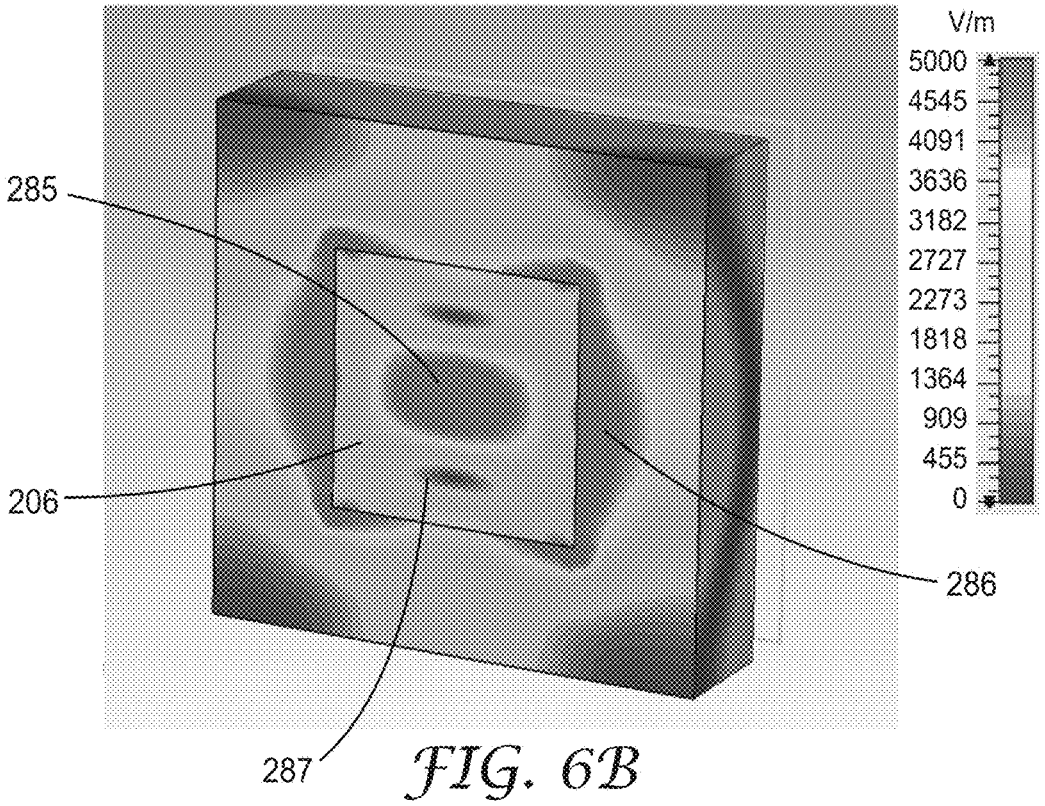
Figure 6C:
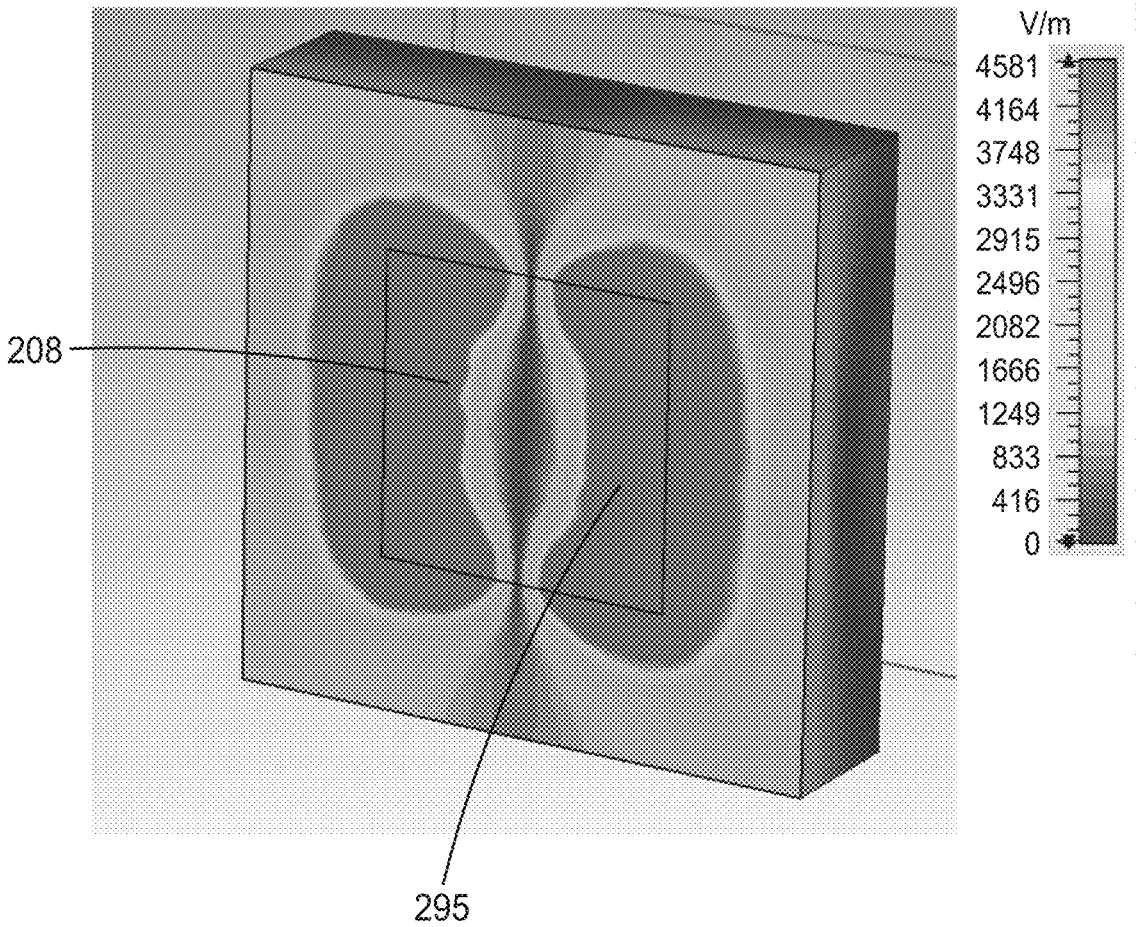

FIGS. 6A-6C are plots of the electric field intensity distributions in a unit cell and surrounding regions the substrate of at various frequencies. A first electric field intensity distribution 205 at the first resonant frequency Γ3 (203) is depicted in FIG. 6A. A second electric field intensity distribution 206 at the lowest resonant frequency Γ2 (202) is depicted in FIG. 6B. A third electric field intensity distribution 208 at the lowest resonant frequency Γ1 (207) is depicted in FIG. 6C. In the illustrated embodiment, the first and second electric field intensity distributions 205 and 206 have a same mode profile and the second and third electric field intensity distributions 206 and 208 have different mode profiles. Intensity distributions have the same overall pattern of high intensity regions in the unit cell can be described as having a same mode profile. For example, the mode profiles for the distribution for the first and second electric field intensity distributions 205 and 206 each have a single region 275 and 285, respectively, near the center of the unit cell having a high electric field intensity and therefore have a same mode profile. The second electric field intensity distribution 206 also has two smaller low electric field intensity regions 287 within the unit cell and high intensity regions 286 just outside the unit cell while the first electric field intensity distribution 205 has smaller high intensity regions 276 just outside the unit cell also has low intensity regions 277 outside the unit cell. The third electric field intensity distribution 208 has two regions 295 of high intensity that are partially inside and partially outside of the unit cell.

The waveguides of the present description can be manufactured using any suitable means. For example, a first substrate can be provided, a first array of metallic rings can be placed onto the first substrate (e.g., via a printing process), an array of dielectric bodies can be paced on and aligned with the first array of metallic rings (e.g., via a printing process or by forming the dielectric bodies separately and then using a pick-and-place process), then a second array of metallic rings can be placed onto the dielectric bodies (e.g., via a printing process), and then a second substrate material can be deposited over the metallic rings and dielectric bodies. For example, second substrate material can be a thermoplastic polymer that can be melted and poured over the unit cells (dielectric bodies with the metallic rings) so that the unit cells are at least partially embedded in the second substrate. The first and second substrate materials may be the same thermoplastic polymer so that the first and second substrate together can be regarded as a single substrate.

In some embodiments, the waveguide is configured to operate at a predetermined operating frequency. For example, the geometry and materials of the waveguide can be selected so that the S21 parameter for the waveguide is a maximum at the predetermined operating frequency. The resonant frequencies of the unit cells, and hence the operating frequency which is typically close to a resonant frequency, can be selected by choosing an appropriate size of the dielectric body, suitable materials and thereby suitable dielectric constants for the dielectric body and for the substrate, and by a suitable conductor coverage. The spacing between unit cells can be chosen so that resonant energy can efficiently transfer between dielectric bodies and result in a sufficiently large S21 parameter at the operating frequency. The resonant frequencies typically scale inversely with the length scales of the dielectric body and inversely with the square root of the dielectric constant of the dielectric body. From a waveguide having a first operating frequency, a waveguide having another operating frequency can be constructed by an appropriate scaling of dimensions and/or by appropriately choosing a material (and hence a dielectric constant) for the dielectric body. Differing geometries and materials can be selected based on known modeling techniques to determine the resonant frequency and suitable operating frequency. For example, the resonant frequencies can be determined by solving (e.g., numerically) Maxwell's equations for the EM modes in the unit cell with the appropriate boundary conditions. After fabrication unit cells and a waveguide, the resonant frequencies can be determined by measuring the S-parameters as a function of frequency since this allows the resonant frequencies to be identified.

Figure 7:
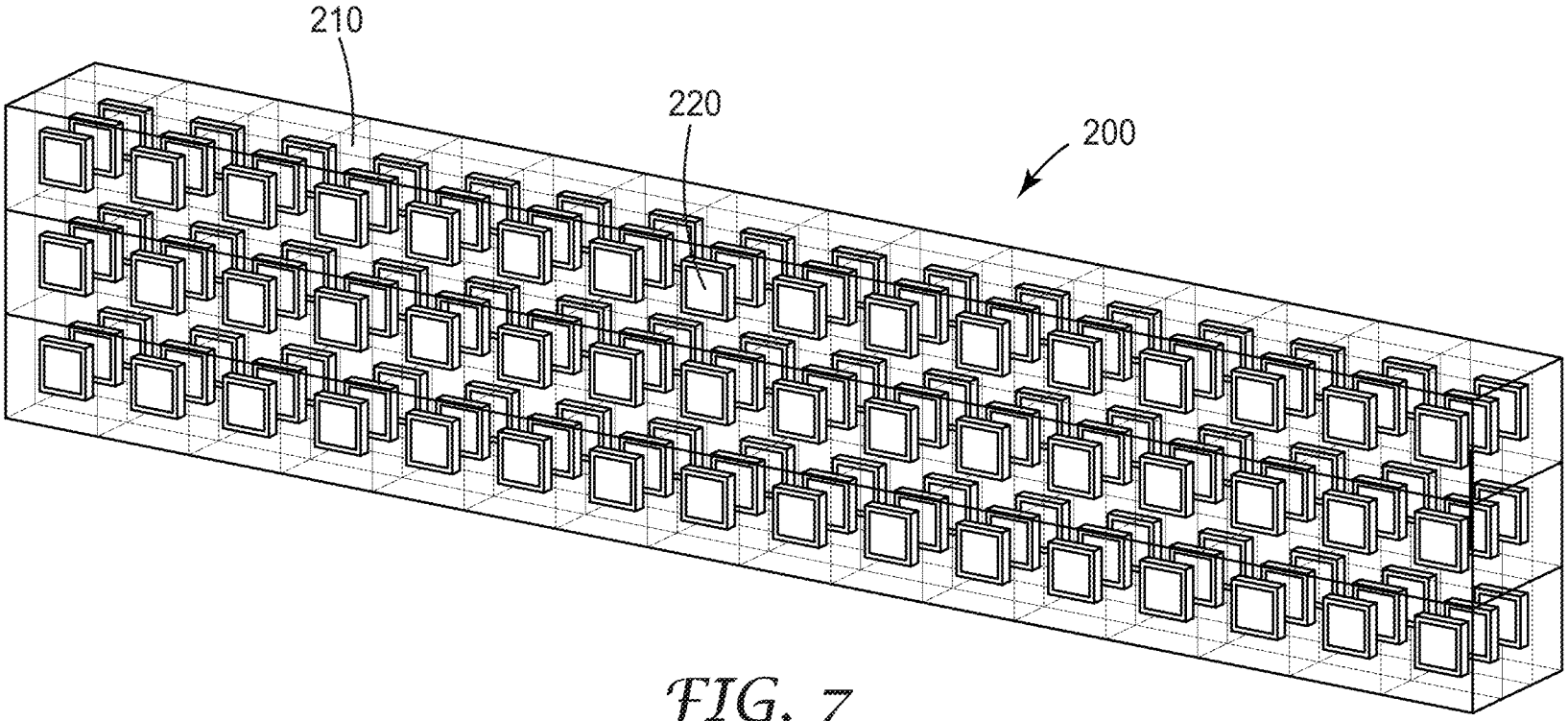
FIG. 7 is a perspective view of a waveguide.

A wide variety of geometries for the unit cells and for the arrangement of the unit cells can be utilized. In some embodiments, the unit cells are arranged in a regular array. In some embodiments, the array is a square or rectangular array. In some embodiments, the array of unit cells comprises unit cells on a hexagonal or triangular lattice. The unit cells may be arranged in a cylindrical shape, a stacked matrix, or a pipe shape, for example. Useful geometries are described in PCT Pub. Nos. WO 2016/171930 (Weinmann et al.) and WO 2016/172020 (Kim et al.), for example. The array of spaced apart unit cells may be a one-dimensional array (e.g., the waveguide could include only one of the three rows of unit cells depicted in FIG. 1A), a two-dimensional array (e.g., as illustrated in FIG. 1A), or a three-dimensional array. FIG. 7 is a perspective view of a waveguide 200 including a substrate 210 and an array of spaced apart unit cells 220 at least partially embedded in the substrate 210 and arranged along the waveguide 200. The array of spaced apart unit cells 220 is a three-dimensional array. The unit cells 220 may correspond to the unit cells 20, for example.

Figure 8:
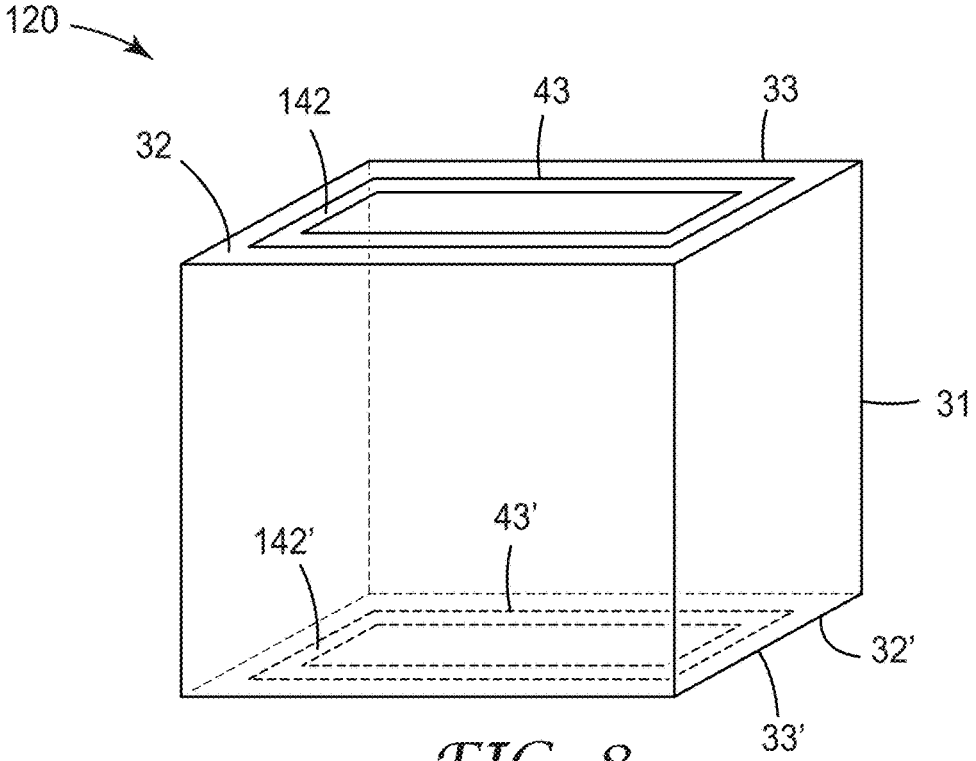
FIGS. 8-9 are schematic perspective views of unit cells.

FIG. 8 is a schematic perspective view of a unit cell 120 which can be used in the waveguides of the present description and which includes a dielectric body 31. The dielectric body 31 has a side 32 having a closed first perimeter 33. A closed loop electrically conductive strip 142 including a closed outer second perimeter 43 coextensive with the first perimeter 33 is disposed on the side 32. The dielectric body 31 also has a side 32' having a closed third perimeter 33'. A closed loop electrically conductive strip 142' including a closed outer fourth perimeter coextensive with the third perimeter 33' is disposed on the side 32'. In some embodiments, one or more electrically conductive layers are disposed on a dielectric body where the one or more electrically conductive layers include substantially identical electrically conductive first (e.g., electrically conductive strip 142) and second (e.g., electrically conductive strip 142') layers disposed on opposite sides (e.g., sides 32 and 32') of the dielectric body and registered and aligned with each other. The first and second layers may be described as substantially identical if they have the same nominal size and shape and use nominally the same materials. Substantially identical first and second layers may differ due to ordinary manufacturing variations, for example, or due to other minor variations that to not appreciably affect the performance of the unit cells.

Figure 9:
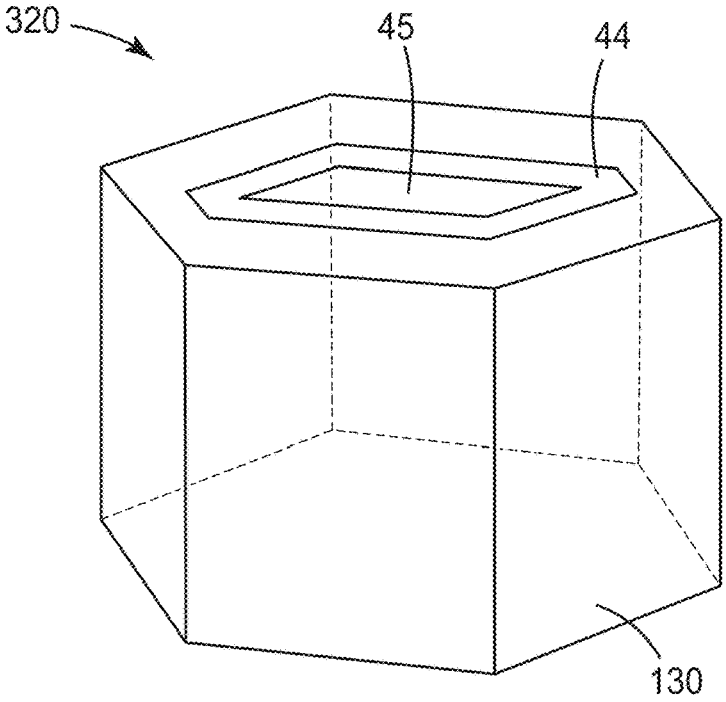
Figure 10C:
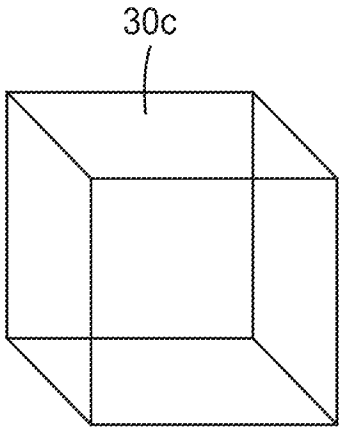
Figure 10B:
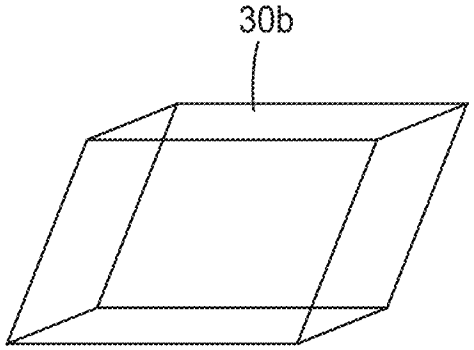
Figure 10A:
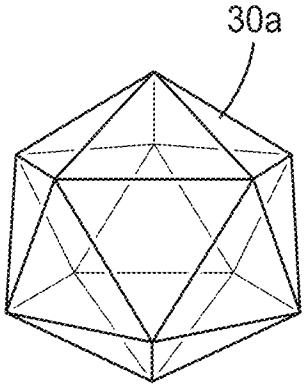
Figure 10G:
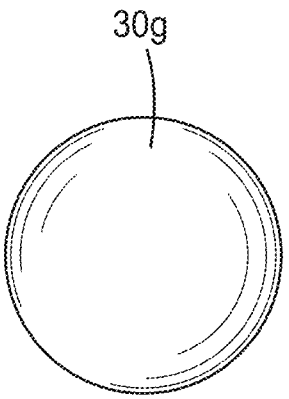
Figure 10H:
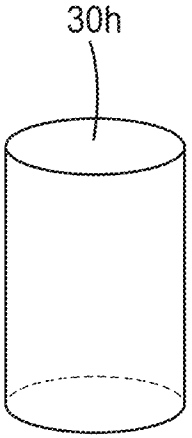
Figure 10I:
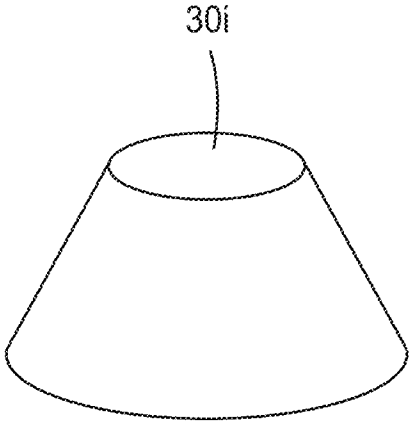
Figure 10J:
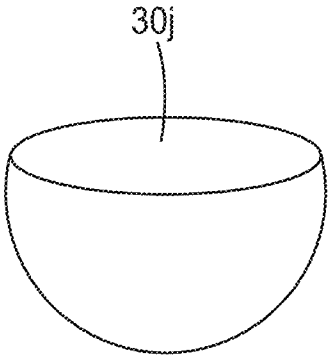

FIG. 9 is a schematic perspective view of a unit cell 320 which can be used in the waveguides of the present description and which includes a dielectric body 130. An electrically conductive layer 44 is disposed on the dielectric body 130. The electrically conductive layer 44 defines an opening 45 therein. In some embodiments, the electrically conductive layer 44 has an irregular shape. In other embodiments, the conductive layer(s) have a regular shape. In some embodiments, the opening 45 allows at least a partial transmission of an incident electromagnetic wave therethrough.

The dielectric body can have any suitable shape. In some embodiments, the dielectric body of at least one unit cell in the array of spaced apart unit cells is at least one of a polyhedron (a solid in three dimensions with planar faces), a parallelepiped, a cube, a square prism, a rectangular prism, a hexagonal prism, a sphere, a cylinder, a frustum (the portion of a cone or pyramid that remains after its upper part has been cut off by a plane parallel to its base, or that is intercepted between two such planes), and a truncated sphere. FIGS. 10A-10J schematically illustrate various exemplary shapes for a dielectric body. FIGS. 10A-10J are perspective views of dielectric bodies 30*a*-30*j*, respectively, which are a polyhedron (30*a*), a parallelepiped (30*b*), a cube (30*c*), a square prism (30*d*), a rectangular prism (30*e*), a hexagonal prism (30*f*), a sphere (30g), a cylinder (30*h*), a frustum (30*i*), and a truncated sphere (30*j*), respectively. The dielectric bodies 30*a*-30*j* can have any suitable orientation in the waveguide.

Terms such as "about" will be understood in the context in which they are used and described in the present description by one of ordinary skill in the art. If the use of "about" as applied to quantities expressing feature sizes, amounts, and physical properties is not otherwise clear to one of ordinary skill in the art in the context in which it is used and described in the present description, "about" will be understood to mean within 10 percent of the specified value. A quantity given as about a specified value can be precisely the specified value. For example, if it is not otherwise clear to one of ordinary skill in the art in the context in which it is used and described in the present description, a quantity having a value of about 1, means that the quantity has a value between 0.9 and 1.1, and that the value could be 1.

The following is a list of exemplary embodiments of the present description.

Embodiment 1 is a waveguide configured to propagate an electromagnetic wave (EMW) having an operating frequency Γ along the waveguide, comprising:

a dielectric substrate comprising a first dielectric constant; and an array of spaced apart unit cells at least partially embedded in the substrate and arranged along the waveguide, each of a plurality of the unit cells in the array of spaced apart unit cells having a first transmission parameter $S_1$21 having a lowest resonant frequency Γ1 and comprising:

a dielectric body having a second dielectric constant greater than the first dielectric constant at the operating frequency and a second transmission parameter $S_2$21 having a lowest resonant frequency Γ2, Γ2>Γ1; and one or more electrically conductive layers disposed on and partially covering the dielectric body.

Embodiment 2 is the waveguide of Embodiment 1 having a length L, a width W and a thickness H, wherein L≥W≥H, or L≥W≥2H, or L≥5 W≥10H.

Embodiment 3 is the waveguide of Embodiment 1 or 2, wherein the operating frequency is in a range from about 10 MHz to about 120 GHz, or from about 10 MHz to about 50

GHz, or from about 1 GHz to about 40 GHz, or from about 1 GHz to about 30 GHz, or from about 1 GHz to about 20 GHz, or from about 1 GHz to about 15 GHz, or from about 10 MHz to about 1 GHz.

Embodiment 4 is the waveguide of any one of Embodiments 1 to 3, wherein the substrate comprises one or more of a polytetrafluoroethylene, a quartz glass, a cordierite, a borosilicate glass, a perfluoroalkoxy, a polyurethane, a polyethylene, silicone, a polyolefin, and a fluorinated ethylene propylene.

Embodiment 5 is the waveguide of any one of Embodiments 1 to 3, wherein the dielectric substrate is air or primarily air.

Embodiment 6 is the waveguide of any one of Embodiments 1 to 5, wherein the first dielectric constant is in a range from about 1 to about 10 at a frequency of about 10 GHz.

Embodiment 7 is the waveguide of any one of Embodiments 1 to 6, wherein the first dielectric constant is in a range from about 1.1 to about 5 at the operating frequency.

Embodiment 8 is the waveguide of any one of Embodiments 1 to 7, wherein each dielectric body comprises one or more of doped or undoped Barium Titanate ($BaTiO_3$), Barium Strontium Titanate ($BaSrTiO_3$), a Y5V composition, an X7R composition, $TiO_2$ (Titanium dioxide), Calcium Copper Titanate ($CaCu_3Ti_4O_{12}$), Lead Zirconium Titanate ($PbZr_xTi_{1-x}O_3$), Lead Titanate ($PbTiO_3$), Lead Magnesium Titanate ($PbMgTiO_3$), Lead Magnesium Niobate-Lead Titanate ($Pb(Mg_{1/3}Nb_{2/3})O_3$—$PbTiO_3$), Iron Titanium Tantalate ($FeTiTaO_6$), NiO co-doped with Li and Ti ($La_{1.5}Sr_{0.5}NiO_4$, $Nd_{1.5}Sr_{0.5}NiO_4$).

Embodiment 9 is the waveguide of any one of Embodiments 1 to 8, wherein the second dielectric constant is in a range from about 10 to about 25000 at the operating frequency, or in a range from about 20 to about 20000 at the operating frequency.

Embodiment 10 is the waveguide of any one of Embodiments 1 to 9, wherein the second dielectric constant is at least 5 times the first dielectric constant at the operating frequency.

Embodiment 11 is the waveguide of any one of Embodiments 1 to 10 being flexible.

Embodiment 12 is the waveguide of any one of Embodiments 1 to 10 being rigid.

Embodiment 13 is the waveguide of any one of Embodiments 1 to 12, wherein the array of the spaced apart unit cells is a one-dimensional array.

Embodiment 14 is the waveguide of any one of Embodiments 1 to 12, wherein the array of the spaced apart unit cells is a two-dimensional array.

Embodiment 15 is the waveguide of any one of Embodiments 1 to 12, wherein the array of the spaced apart unit cells is a three-dimensional array.

Embodiment 16 is the waveguide of any one of Embodiments 1 to 15, wherein at least one unit cell in the array of the spaced apart unit cells is only partially embedded in the substrate.

Embodiment 17 is the waveguide of any one of Embodiments 1 to 15, wherein each unit cell in the array of the spaced apart unit cells is only partially embedded in the substrate.

Embodiment 18 is the waveguide of any one of Embodiments 1 to 15, wherein at least one unit cell in the array of the spaced apart unit cells is fully embedded in the substrate.

Embodiment 19 is the waveguide of any one of Embodiments 1 to 15, wherein each unit cell in the array of the spaced apart unit cells is fully embedded in the substrate.

Embodiment 20 is the waveguide of any one of Embodiments 1 to 19, wherein $\Gamma 1$ is greater than 1 GHz, or greater than 2 GHz.

Embodiment 21 is the waveguide of any one of Embodiments 1 to 20, wherein $\Gamma 1$ is less than 10 GHz.

Embodiment 22 is the waveguide of any one of Embodiments 1 to 20, wherein $\Gamma 2$ is greater than 5 GHz, or greater than 10 GHz, or greater than 15 GHz.

Embodiment 23 is the waveguide of any one of Embodiments 1 to 22, wherein $\Gamma 2-\Gamma 1$ is at least 1 GHz, or at least 2 GHz, or at least 5 GHz, or at least 7 GHz, or at least 10 GHz.

Embodiment 24 is the waveguide of any one of Embodiments 1 to 23, wherein the dielectric body of at least one unit cell in the array of spaced apart unit cells is at least one of a polyhedron, a parallelepiped, a cube, a square prism, a rectangular prism, a hexagonal prism, a sphere, a cylinder, a frustum, or a truncated sphere.

Embodiment 25 is the waveguide of any one of Embodiments 1 to 24, wherein at least one layer in the one or more electrically conductive layers comprises a metal.

Embodiment 26 is the waveguide of any one of Embodiments 1 to 24, wherein at least one layer in the one or more electrically conductive layers comprises a metal selected from the group consisting of silver, gold, copper, aluminum, platinum, and alloys thereof.

Embodiment 27 is the waveguide of any one of Embodiments 1 to 24, wherein at least one layer in the one or more electrically conductive layers comprises an electrically conductive ceramic selected from the group consisting of doped and undoped $LaCrO_3$, Indium Tin Oxide, TiO, $TiC_xN_{1-x}$, $RuO_2$, ZrC, TiC, TiN, TaN, $ZrB_{2x}$—$B_4C_{1-x}$, and $ZrB_{2x}$—$SiC_{1-x}$.

Embodiment 28 is the waveguide of any one of Embodiments 1 to 27, wherein at least one layer in the one or more electrically conductive layers comprises a closed loop electrically conductive strip.

Embodiment 29 is the waveguide of any one of Embodiments 1 to 28, wherein an average thickness of at least one layer in the one or more electrically conductive layers is in a range from about 100 nm to about 100 micrometers, or from about 100 nm to about 10 micrometers, or from about 100 nm to about 5 micrometers.

Embodiment 30 is the waveguide of any one of Embodiments 1 to 29, wherein the dielectric body comprises a side comprising a closed first perimeter and one layer in the one or more electrically conductive layers comprises a closed loop electrically conductive strip comprising a closed outer second perimeter coextensive with the first perimeter.

Embodiment 31 is the waveguide of any one of Embodiments 1 to 30, wherein at least one layer in the one or more electrically conductive layers defines an opening therein to allow at least a partial transmission of an incident electromagnetic wave therethrough.

Embodiment 32 is the waveguide of any one of Embodiments 1 to 31, wherein the one or more electrically conductive layers comprises substantially identical electrically conductive first and second layers disposed on opposite sides of the dielectric body and registered and aligned with each other.

Embodiment 33 is the waveguide of any one of Embodiments 1 to 32, wherein each of the plurality of the unit cells in the array of spaced apart unit cells has a first reflection parameter $S_111$, and wherein $S_111$ and $S_121$ are within 10% of each other, or with 5% of each other at the operating frequency $\Gamma$.

Embodiment 34 is the waveguide of any one of Embodiments 1 to 32, wherein each of the plurality of the unit cells in the array of spaced apart unit cells has a first reflection parameter $S_1 11$, and wherein $S_1 11$ is equal to $S_1 21$ at the operating frequency Γ.

Embodiment 35 is the waveguide of any one of Embodiments 1 to 34, wherein each unit cell has a first electric field distribution at a first resonant frequency Γ3 of the first transmission parameter $S_1 21$ and each dielectric body has a second electric field distribution at the lowest resonant frequency Γ2 of the second transmission parameter $S_2 21$, the first and second electric field intensity distributions having a same mode profile.

Embodiment 36 is the waveguide of any one of Embodiments 1 to 35, wherein each unit cell is configured to couple to the EMW with a first coupling efficiency and each dielectric body is configured to couple to the EMW with a second coupling efficiency, the second coupling efficiency being substantially smaller than the first coupling efficiency.

Embodiment 37 is a communication system comprising the waveguide of any one of Embodiments 1 to 36.

Embodiment 38 is a waveguide comprising a dielectric substrate and an array of spaced apart unit cells at least partially embedded in the substrate and arranged along the waveguide, each unit cell comprising:

a first transmission parameter $S_1 21$ having a first resonant frequency Γ3 having a first electric field intensity distribution;

a dielectric body having a second transmission parameter $S_2 21$ having a lowest resonant frequency Γ2 having a second electric field intensity distribution, the first and second electric field intensity distributions having a same mode profile; and a metal layer disposed on and partially covering the dielectric body, wherein the first resonant frequency Γ3 is not a lowest resonant frequency Γ1 of $S_1 21$.

Embodiment 39 is the waveguide of Embodiment 38, wherein the lowest resonant frequency Γ1 of $S_1 21$ has a third electric field intensity distribution, and wherein the second and third electric field intensity distributions have different mode profiles.

Embodiment 40 is the waveguide of Embodiment 38 or 39 being configured to propagate an electromagnetic wave having an operating frequency Γ along the waveguide, wherein the dielectric substrate has a first dielectric constant, the dielectric body has a second dielectric constant, the second dielectric constant being greater than the first dielectric constant at the operating frequency.

Embodiment 41 is the waveguide of Embodiment 40, wherein the second dielectric constant is at least 5 times the first dielectric constant.

Embodiment 42 is the waveguide of any one of Embodiments 38 to 41, wherein the metal layer defines an opening therein to allow at least a partial transmission of an incident electromagnetic wave therethrough.

Embodiment 43 is the waveguide of any one of Embodiments 38 to 42, wherein each unit cell is configured to couple to an incident electromagnetic wave (EMW) having an operating frequency of the waveguide with a first coupling efficiency and each dielectric body is configured to couple to the incident EMW with a second coupling efficiency, the second coupling efficiency being substantially smaller than the first coupling efficiency.

Embodiment 44 is the waveguide of any one of Embodiments 38 to 43, wherein the substrate comprises one or more of a polytetrafluoroethylene, a quartz glass, a cordierite, a borosilicate glass, a perfluoroalkoxy, a polyurethane, a polyethylene, silicone, a polyolefin, and a fluorinated ethylene propylene.

Embodiment 45 is the waveguide of any one of Embodiments 38 to 44, wherein each dielectric body comprises one or more of doped or undoped Barium Titanate ($BaTiO_3$), Barium Strontium Titanate ($BaSrTiO_3$), a Y5V composition, an X7R composition, $TiO_2$ (Titanium dioxide), Calcium Copper Titanate ($CaCu_3Ti_4O_{12}$), Lead Zirconium Titanate ($PbZr_xTi_{1-x}O_3$), Lead Titanate ($PbTiO_3$), Lead Magnesium Titanate ($PbMgTiO_3$), Lead Magnesium Niobate-Lead Titanate ($Pb(Mg_{1/3}Nb_{2/3})O_3$—$PbTiO_3$), Iron Titanium Tantalate ($FeTiTaO_6$), NiO co-doped with Li and Ti ($La_{1.5}Sr_{0.5}NiO_4$, $Nd_{1.5}Sr_{0.5}NiO_4$).

Embodiment 46 is the waveguide of any one of Embodiments 38 to 45, wherein each unit cell in the array of spaced apart unit cells has a first reflection parameter $S_1 11$, and wherein $S_1 11$ and $S_1 21$ are within 10% of each other, or within 5% of each other, at an operating frequency Γ of the waveguide.

Embodiment 47 is the waveguide of any one of Embodiments 38 to 45, wherein each unit cell in the array of spaced apart unit cells has a first reflection parameter $S_1 11$, and wherein $S_1 11$ is equal to $S_1 21$ at an operating frequency Γ of the waveguide.

Embodiment 48 is the waveguide of any one of Embodiments 38 to 47, being further characterized according to any one of Embodiments 1 to 36.

Embodiment 49 is a communication system comprising the waveguide of any one of Embodiments 38 to 48.

Embodiment 50 is a communication system comprising:

a first transceiver configured to emit an electromagnetic wave (EMW) having an operating frequency Γ; and a waveguide for receiving the emitted EMW having the operating frequency Γ from the first transceiver, comprising:

a substrate extending between first and second locations of the waveguide; and an array of spaced apart unit cells at least partially embedded in the substrate and extending between the first and second locations of the waveguide, the unit cells configured to resonantly couple to the emitted EMW having the operating frequency Γ at the first location and radiate an EMW at the operating frequency propagating inside and along the waveguide from the first location to the second location along the waveguide, each unit cell having a first transmission parameter $S_1 21$ and a first reflection parameter $S_1 11$, $S_1 21$ and $S_1 11$ being within 10% of each other at the operating frequency Γ.

Embodiment 51 is the communication system of Embodiment 50, wherein the first transceiver comprises a first antenna.

Embodiment 52 is the communication system of Embodiment 51, wherein the first transceiver further comprises a first power source to energize the first antenna.

Embodiment 53 is the communication system of any one of Embodiments 50 to 52 further comprising a second transceiver configured to resonantly couple to the EMW propagating inside and along the waveguide at the second location of the waveguide.

Embodiment 54 is the communication system of Embodiment 53, wherein the second transceiver is further configured to radiate the coupled EMW to a location remote from the waveguide.

Embodiment 55 is the communication system of Embodiment 53 or 54, wherein the second transceiver comprises a second antenna.

Embodiment 56 is the communication system of Embodiment 55, wherein the second transceiver further comprises a second power source to energize the second antenna.

Embodiment 57 is the communication system of any one of Embodiments 50 to 56, wherein $S_1 21$ and $S_1 11$ are within 5% of each other at the operating frequency Γ.

Embodiment 58 is the communication system of any one of Embodiments 50 to 56, wherein $S_1 11$ is equal to $S_1 21$ at the operating frequency Γ.

Embodiment 59 is the communication system of any one of Embodiments 50 to 58, wherein the substrate has a first dielectric constant and each unit cell comprises a dielectric body having a second dielectric constant, the second dielectric constant being greater than the first dielectric constant at the operating frequency.

Embodiment 60 is the communication system of Embodiment 59, wherein the second dielectric constant is at least 5 times the first dielectric constant.

Embodiment 61 is the communication system of any one of Embodiments 50 to 60, wherein the waveguide is further characterized according to any one of Embodiments 1 to 36.

Embodiment 62 is a waveguide for receiving an incident electromagnetic wave (EMW) having an operating frequency Γ and comprising an array of spaced apart unit cells arranged along the waveguide, the unit cells configured to resonantly couple to the incident EMW and radiate an EMW at the operating frequency propagating inside and along the waveguide, each unit cell configured to couple to the incident EMW with a first coupling efficiency and comprising:
a dielectric body configured to couple to the incident EMW with a second coupling efficiency; and
one or more metal layers disposed on and partially covering the dielectric body, wherein the second coupling efficiency is substantially smaller than the first coupling efficiency.

Embodiment 63 is the waveguide of Embodiment 62, wherein the second coupling efficiency is at least 10 times smaller than the first coupling efficiency.

Embodiment 64 is the waveguide of Embodiment 62 or 63, wherein the array of spaced apart unit cells is at least partially embedded in a substrate having a first dielectric constant, each dielectric body has a second dielectric constant, the second dielectric constant being greater than the first dielectric constant at the operating frequency Γ.

Embodiment 65 is the waveguide of Embodiment 64, wherein the second dielectric constant is at least 5 times the first dielectric constant.

Embodiment 66 is the waveguide of any one of Embodiments 62 to 65, wherein the one or more metal layers has a least one layer defining an opening therein to allow at least a partial transmission of an incident electromagnetic wave therethrough.

Embodiment 67 is the waveguide of any one of Embodiments 62 to 66 being further characterized according to any one of Embodiments 1 to 36.

Embodiment 68 is a communication system comprising the waveguide of any one of Embodiments 62 to 67.

Descriptions for elements in figures should be understood to apply equally to corresponding elements in other figures, unless indicated otherwise. Although specific embodiments have been illustrated and described herein, it will be appreciated by those of ordinary skill in the art that a variety of alternate and/or equivalent implementations can be substituted for the specific embodiments shown and described without departing from the scope of the present disclosure. This application is intended to cover any adaptations or variations of the specific embodiments discussed herein. Therefore, it is intended that this disclosure be limited only by the claims and the equivalents thereof.

All cited references, patents, and patent applications in the above application for letters patent are herein incorporated by reference in their entirety in a consistent manner. In the event of inconsistencies or contradictions between portions of the incorporated references and this application, the information in the preceding description shall control.

What is claimed is:

1. A waveguide for receiving an incident electromagnetic wave (EMW) having an operating frequency Γ and comprising an array of spaced apart unit cells arranged along the waveguide, the unit cells configured to resonantly couple to the incident EMW and radiate an EMW at the operating frequency propagating inside and along the waveguide, each unit cell configured to couple to the incident EMW with a first coupling efficiency and comprising:
a dielectric body configured to couple to the incident EMW with a second coupling efficiency; and
one or more metal layers disposed on and partially covering the dielectric body, wherein the second coupling efficiency is substantially smaller than the first coupling efficiency.

2. The waveguide of claim 1, wherein the second coupling efficiency is at least 10 times smaller than the first coupling efficiency.

3. The waveguide of claim 2, wherein the array of spaced apart unit cells is at least partially embedded in a substrate having a first dielectric constant, each dielectric body has a second dielectric constant, the second dielectric constant being greater than the first dielectric constant at the operating frequency Γ.

4. The waveguide of claim 3, wherein the second dielectric constant is at least 5 times the first dielectric constant at the operating frequency Γ.

5. The waveguide of claim 3, wherein the first dielectric constant is in a range from about 1.1 to about 5 at the operating frequency Γ, and the second dielectric constant is in a range from about 10 to about 25000 at the operating frequency Γ.

6. The waveguide of claim 1, wherein the one or more metal layers comprises a least one layer defining an opening therein to allow at least a partial transmission of an incident electromagnetic wave therethrough.

7. The waveguide of claim 1, wherein the dielectric body comprises a side comprising a closed first perimeter, and wherein the one or more metal layers comprises a closed loop electrically conductive strip comprising a closed outer second perimeter coextensive with the first perimeter.

8. The waveguide of claim 1, wherein the one or more metal layers comprises substantially identical electrically conductive first and second layers disposed on opposite sides of the dielectric body and registered and aligned with each other.

9. The waveguide of claim 1, wherein for each of a plurality of the unit cells in the array of spaced apart unit cells, the unit cell has a first transmission parameter $S_1 21$ having a lowest resonant frequency Γ1, and the dielectric body of the unit cell has a second transmission parameter $S_2 21$ having a lowest resonant frequency Γ2, Γ2>Γ1.

10. The waveguide of claim 1, wherein each unit cell has a first transmission parameter $S_1 21$ having a first resonant frequency Γ3 having a first electric field intensity distribution, and each dielectric body has a second transmission parameter $S_2 21$ having a lowest resonant frequency Γ2 having a second electric field intensity distribution, the first and second electric field intensity distributions having a same mode profile.

11. The waveguide of claim 10, wherein the first resonant frequency Γ3 is not a lowest resonant frequency Γ1 of $S_1$21.

12. The waveguide of claim 10, wherein each unit cell in the array of spaced apart unit cells has a first reflection parameter $S_1$11, and wherein $S_1$11 and $S_1$21 are within 10% of each other at the operating frequency Γ of the waveguide.

13. The waveguide of claim 10, wherein a lowest resonant frequency Γ1 of $S_1$21 has a third electric field intensity distribution, and wherein the second and third electric field intensity distributions have different mode profiles.

14. The waveguide of claim 13, wherein Γ1 is greater than 1 GHz.

15. A communication system comprising:

the waveguide of claim 1; and a transceiver configured to emit an EMW having the operating frequency Γ such that the waveguide receives the emitted EMW.

* * * * *